United States Patent [19]

Palazzolo et al.

[11] Patent Number: 4,683,801

[45] Date of Patent: Aug. 4, 1987

[54] REMOTELY-OPERATED TRAVEL LOCK FOR VEHICLE MAIN GUN

[75] Inventors: Faro D. Palazzolo, Oakland, Mich.; Brian L. Drake, Cook; Ralph R. Swanson, Will, both of Ill.

[73] Assignee: The United States of America as represented by the Secretary of the Army, Washington, D.C.

[21] Appl. No.: 864,639

[22] Filed: May 16, 1986

[51] Int. Cl.[4] ..... F41H 7/12

[52] U.S. Cl. ..... 89/40.12

[58] Field of Search ..... 89/40.12; 212/188

[56] References Cited

U.S. PATENT DOCUMENTS 4,483,447 11/1984 Bernabe ..... 212/188

FOREIGN PATENT DOCUMENTS 2051853 4/1972 Fed. Rep. of Germany ..... 89/40.12

1306920 2/1973 United Kingdom ..... 89/40.12

*Primary Examiner*—Stephen C. Bentley

*Assistant Examiner*—Stephen M. Johnson

*Attorney, Agent, or Firm*—Peter A. Taucher; John E. McRae

[57] ABSTRACT

A remotely-operated lock mechanism for the main gun of a military vehicle. An arm structure is swingable between a prone (inactive) position and an upright position disposed to bear the weight of the main gun. A clamp device is swingably attached to the arm structure for movement between a position overlying the gun barrel and another position displaced laterally from the gun barrel. A single power mechanism is remotely actuable to operate both the arm structure and the clamp device.

10 Claims, 9 Drawing Figures

REMOTELY-OPERATED TRAVEL LOCK FOR VEHICLE MAIN GUN

GOVERNMENT INTEREST

The invention described herein may be manufactured, used, and licensed by or for the Government for governmental purposes without payment to us of any royalty thereon.

BACKGROUND AND SUMMARY OF THE INVENTION

Military vehicles are sometimes equipped with heavy main guns designed to fire high explosive shells over relatively long distances (one or more miles). Such vehicles sometimes are capable of fairly high road speeds, e.g., thirty-five miles per hour.

The heavy main gun on a given vehicle can project (extend) a considerable distance from the associated gun turret, e.g., twenty or more feet. During vehicle travel over rough terrain the muzzle end of the heavy gun functions somewhat like a heavy pendulum. The gun tends to swing up and down so as to induce a rocking or pitching motion in the moving vehicle. Considerable strain is placed on the turret structure, the gun elevating mechanism, and possibly the vehicle suspension. Additionally, the vehicle occupants are jolted back and forth, with some physical discomfort. In some cases it may be necessary to run the vehicle at an undesirably low road speed in order to minimize some or all of the undesired effects.

To minimize the undesired pendulum motion of the gun barrel some vehicles have been equipped with travel locks. A travel lock comprises an elongated arm structure mounted at or near the front end (nose) of the vehicle hull on the longitudinal axis of the vehicle, i.e., directly under the main gun when the gun is in its straight-ahead position. The travel lock arm structure can be swung in a vertical plane between an inactive prone position lying against the upper external surface of the hull and an upright active position extending upwardly toward the barrel of the main gun.

The free end of the travel lock arm structure has a concave seat conforming to the contour of the gun barrel, whereby when the arm structure is in its upright position the heavy gun can be lowered so that the gun barrel undersurface rests against the concave seat. A semi-circular clamp arm is pivotally attached to the upper end of the arm structure at a point near the concave seat, such that the clamp arm can be manually swung up and over the gun barrel; the concave surface of the clamp arm engages the upper surface of the gun barrel to prevent upward dislocation of the barrel from the aforementioned concave seat. A toggle bolt releasably secures the free end of the clamp arm to the travel lock proper.

When the vehicle is operating under battlefield conditions (firing mode) the travel lock is manually disengaged from the gun barrel and swung down to a prone (inactive) position lying against the hull upper face.

In its operating position the travel lock acts as a rigid link between the nose end of the hull and a mid point on the barrel (forward from the turret). The travel lock thus provides a second support point for the gun, forwardly from the gun trunnions. The effective length of the aforementioned pendulum is considerably reduced so that disturbing forces on the vehicle-gun components are greatly reduced. Performance of the vehicle suspension is improved, with less rocking (pitching) motion of the vehicle, and less physical discomfort to the passengers.

A principal disadvantage of existing external travel locks is the fact that in order to switch the lock between the active (upright) position and the inactive (prone) position it is necessary for one or more soldiers to disembark from the vehicle to lock/unlock the clamp arm and swing the arm structure up or down onto the hull. The operation is somewhat time-consuming. More importantly, if the operation is carried out in/near a battle zone the disembarked soldiers are exposed to enemy fire; additionally the vehicle is required to be in a standstill attitude vulnerable to enemy attack.

The present invention is directed to an external travel lock that is remotely operable from within the vehicle. Such remote operation is advantageous in that no soldiers are exposed to enemy fire while the travel lock is being adjusted between its active (barrel-lock) mode and inactive mode. It is possible to carry out the operation while the vehicle is moving, whereby the vehicle has lessened exposure to enemy fire.

The invention was conceived especially for use with U.S. military vehicles designated as the M109A2 and M109A3. Each of these vehicles is a tracked vehicle having a 155 mm howitzer main gun mounted on an armored turret. It is believed that the invention could be used on other military vehicles.

THE DRAWINGS

THE DRAWING IN GREATER DETAIL

Figure 1:
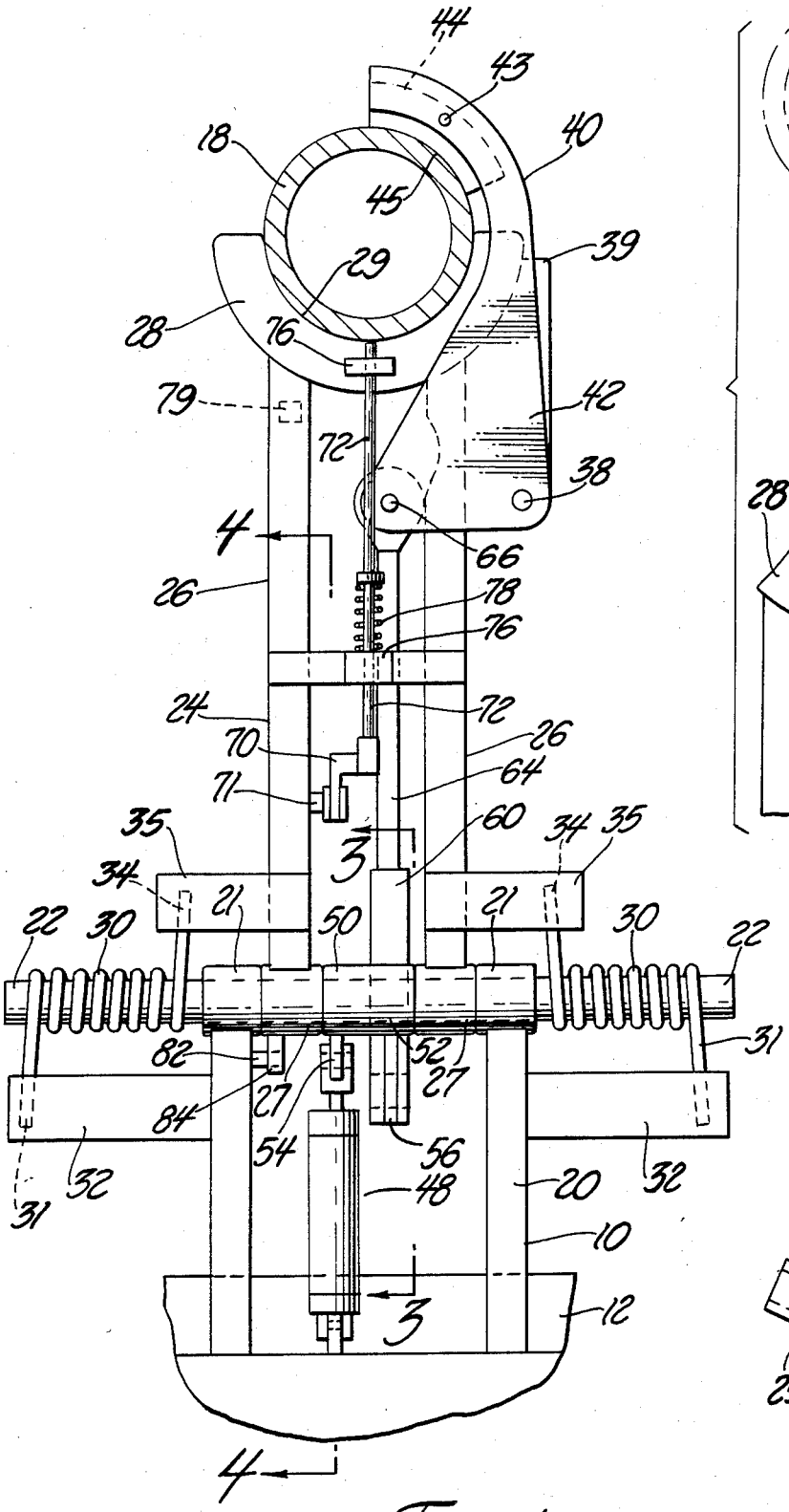
FIG. 1 is a front elevational view of a travel lock embodying our invention.
Figure 3:
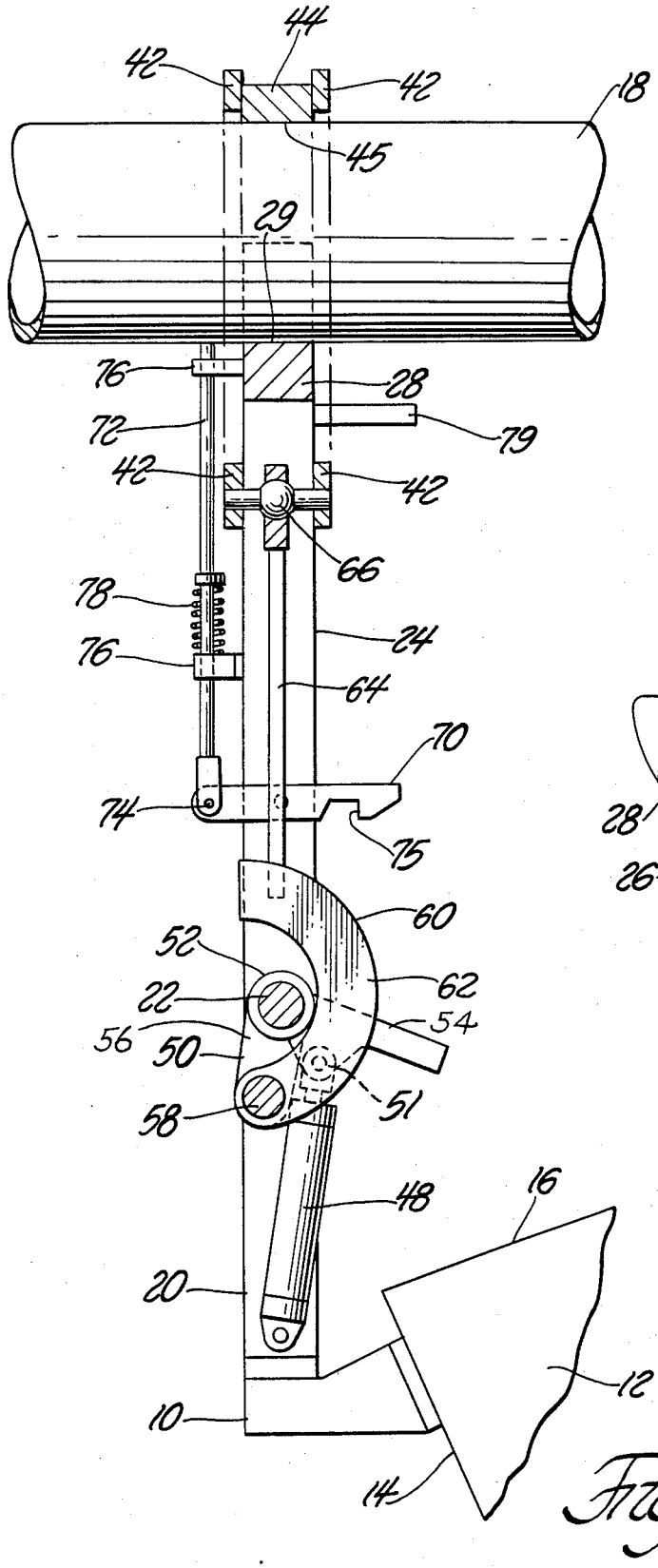
FIG. 3 is a sectional view taken on line 3—3 in FIG. 1.

As shown in the FIGS. 1 and 3, the travel lock comprises a base structure 10 suitably secured to the front (nose) end 12 of a military vehicle. FIG. 3 fragmentarily shows the vehicle hull front surface 14 and hull upper surface 16. Numeral 18 fragmentarily shows the barrel of the main gun (which can be a 155 mm howitzer, 120 mm smooth bore gun, etc). In FIG. 3 the turret (which mounts the gun) is to the right of the illustrated structure; the gun fires in a right-to-left direction.

Figure 6:
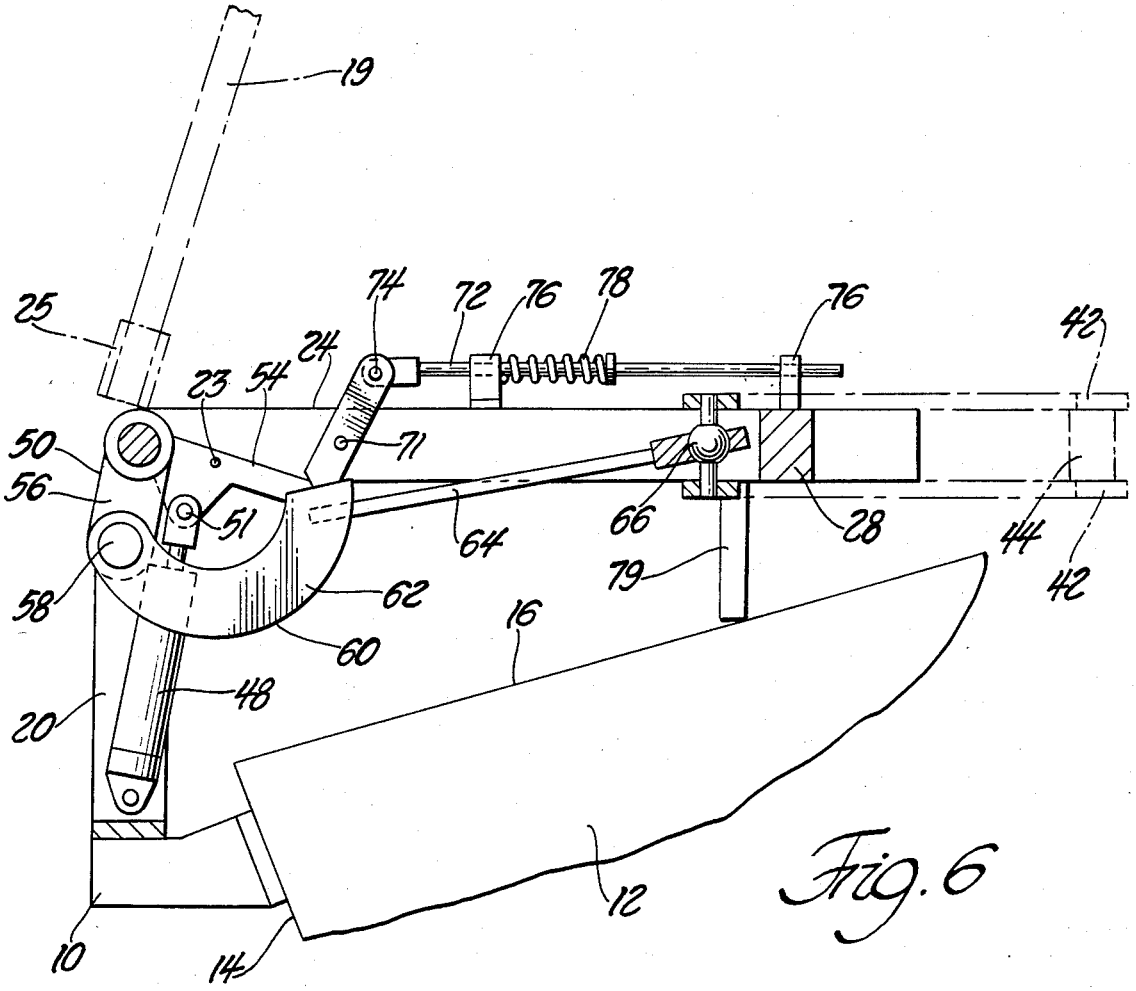
FIGS. 6 and 7 are views taken in essentially the same directions as FIGS. 3 and 4, but illustrating the travel lock in a different condition of adjustment (inactive).
Figure 7:
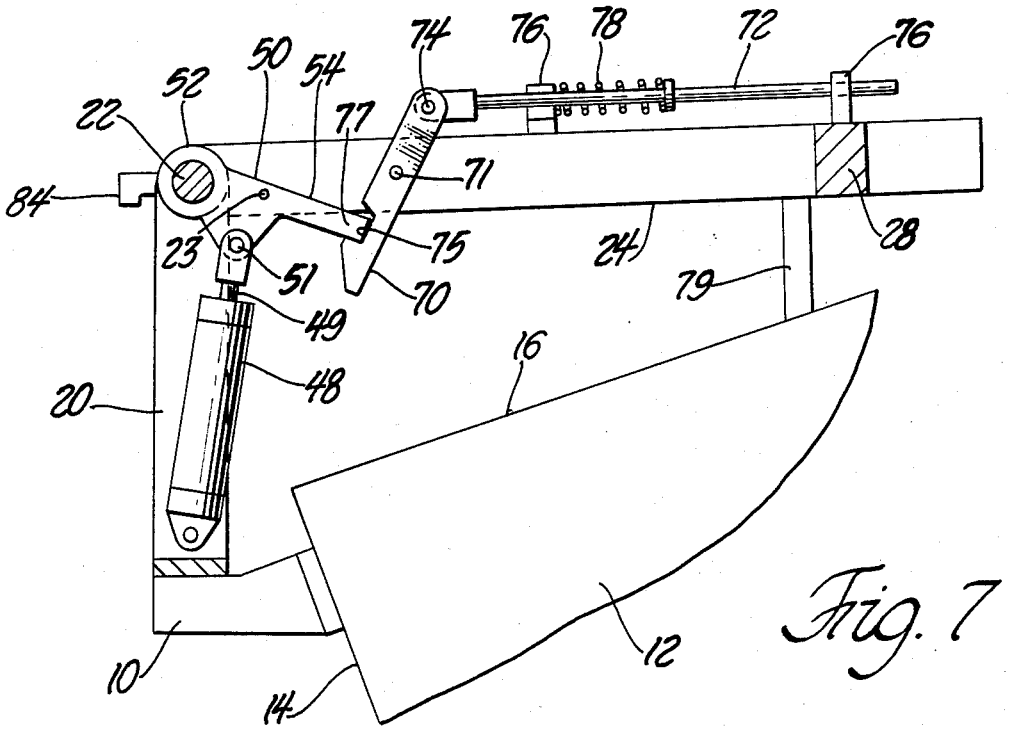

FIG. 3 illustrates the gun barrel in the grip of the travel lock. The travel lock forms a rigid link between the front nose area 12 of the vehicle and a midpoint on the gun barrel; this minimizes the pendulum effect previously discussed. FIGS. 6 and 7 illustrate the travel lock in a prone (inactive) position lying on the vehicle hull upper surface; the gun is free to move in the elevational plane and in the azimuth plane (due to turret rotation) for firing purposes.

Figure 2:
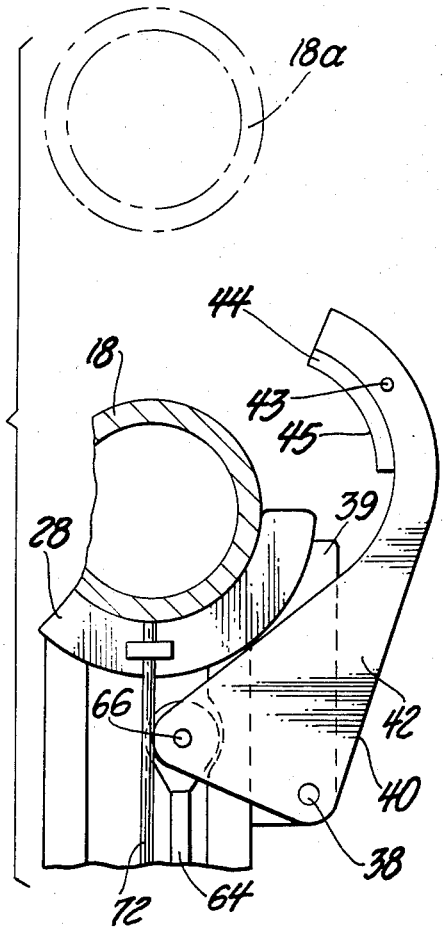
FIG. 2 is a fragmentary view taken in the same direction as FIG. 1, but showing a clamp device in a different condition of adjustment (unclamped).

A power means 48 is provided for moving the travel lock between its prone and upright positions. The power means also operates a clamp structure 40 between a closed condition engaged with the gun barrel (FIG. 1) and an open condition disengaged from the barrel (FIG. 2). The travel lock is located on the longitudinal axis of the vehicle. Consequently, gun barrel 18 has to be oriented in a straight-ahead attitude in order for it to be locked to the travel lock mechanism (as shown in FIGS. 1 and 3).

BASE STRUCTURE 10

Aforementioned base structure 10 can include two upstanding bars 20 having sleeve-like upper end areas 21 secured to a transverse horizontal shaft 22, by welding or other means. The base structure can include various other rigidifying bars, plates, bolts, etc. not specifically detailed in the attached drawings. Bars 20 and shaft 22 constitute the connection points between the base structure and other component parts of the travel lock.

ARM STRUCTURE 24

The main structural component of the travel lock comprises an elongated arm structure 24 that may include two parallel bars 26; lower end areas of these bars are affixed to collars 27 that encircle shaft 22. Arm structure 24 can swing (rotate) around the axis of shaft 22.

The upper (free) ends of bars 26 are connected to a semi-circular wall 28, whose concave surface 29 forms a seat for the gun barrel 18 (when arm structure 24 is in its upright position of FIGS. 1 and 3). Seat surface 29 is formed out of a lining material having friction grip properties similar to those possessed by vehicle brake linings. To counterbalance the weight of arm structure 24 coil springs 30 may be coiled around shaft 22. End areas 31 of the springs are suitably anchored to arms 32 carried by bars 20. End areas 34 of the springs are anchored to arms 35 carried by bars 26. The springs are coiled so as to urge arm structure 24 from its FIG. 5 prone position to its FIG. 3 upright position.

CLAMP DEVICE 40

Arm structure 24 includes a block-like extension 39 that has a pivotal connection 38 with a clamp device 40. Clamp device 40 comprises two spaced steel sheets 42 and an intervening pad 44. Concave surface 45 of pad 44 conforms to the contour of the gun barrel upper surface, whereby when clamp device 40 is in the position of FIGS. 1 and 3 pad surface 45 engages the gun barrel upper surface to prevent upward dislocation of the gun barrel from seat surface 29. Pad surface 45 is formed out of a material that possesses friction grip properties, similar to aforementioned surface 29. Preferably pad 44 has a pivot connection 43 with steel sheets 42, whereby the pad surface 45 is enabled to closely conform to the gun barrel surface in spite of manufacturing tolerances.

Clamp device 40 can be moved to the FIG. 2 open condition (around pivot connection 38), wherein the device is disengaged from gun barrel 18. Suitable limit stops may be provided to limit motion of clamp device 40. In one form of the invention the operating stroke of cylinder 48 provides the stop (limit) action; i.e., when the end of the stroke is reached the clamp device is in its open position. With clamp device 40 in the FIG. 2 position the gun barrel can be elevated from seat surface 29 to any attainable position within the capability of the gun-raise equipment in the gun turret. One such elevated position is shown at 18*a* (in dashed lines in FIG. 2). After the gun is in an elevated position arm structure 24 can be swung downward from the FIG. 3 upright position to the FIG. 6 prone (inactive) position.

RECIPROCABLE POWER MEANS 48

The mechanism for raising or lowering arm structure 24 comprises a reciprocable power means 48 trained between base structure 10 and a crank arm assembly 50. Power means 48 is shown as a hydraulic cylinder; it could be another type of reciprocable power means such as a motorized ball-screw unit or linear electric motor or motor-operated sector gear.

Hydraulic cylinder 48 is preferably a double acting cylinder adapted to receive pressure fluid at its upper end or its lower end to move piston rod 49 into or out of the cylinder. Fluid supply lines (and exhaust lines) extend from the cylinder into the vehicle hull. Control valves for the fluid cylinder are located within the hull, whereby cylinder 48 is operable without requiring that the soldiers disembark from the vehicle.

CRANK ARM 50

Crank arm assembly 50 comprises a sleeve 52 rotatably encircling shaft 22, and two laterally spaced plates 54 and 56 welded or otherwise secured to sleeve 52. The reason for using two spaced plates 54 and 56 (instead of one plate) is to achieve desired clearance between the crank arm and piston rod portion 49 of hydraulic cylinder 48. The necessary pivotal connection 51 between piston rod 49 and crank arm assembly 50 is made on plate 54.

Plate portion 56 of the crank arm has a pivotal connection 58 with an elongated link member 60.

LINK MEMBER 60

Link member 60 comprises a C-shaped wall 62 and elongated rod 64. Rod 64 and wall 62 act as one unitary structure. The length of link member 60 may be adjusted to compensate for manufacturing tolerances, as by making rod 64 as a multi-piece adjustable length mechanism.

The upper (or right) end of rod 64 has a pivotal connection 66 with the aforementioned clamp device 40. Pivotal connection 66 preferably includes a ball-socket component that permits relative movement between rod 64 and clamp device 40 in two planes, e.g., the plane of the paper and normal to the plane of the paper in FIGS. 3 and 6.

As seen in FIG. 1, pivot connection 38 is offset laterally from the vertical centerplane of arm structure 24, i.e., a plane taken midway between bars 26. pivot connection 66 is near the centerplane of arm structure 24. As seen in FIG. 2, pivot connection 66 is somewhat offset from the centerplane of arm structure 24. Upward motion of rod 64 (by operation of crank arm 50) can produce a swinging motion of clamp device 40 around its pivotal connection 38 with arm structure 24 (i.e., extension 39), thereby shifting device 40 from the FIG. 1 closed condition to the FIG. 2 open condition. Downward motion of rod 64 (by crank arm 50) can move clamp device 40 from the FIG. 2 open condition to the FIG. 1 closed condition.

LATCH DEVICE 70

Figure 4:
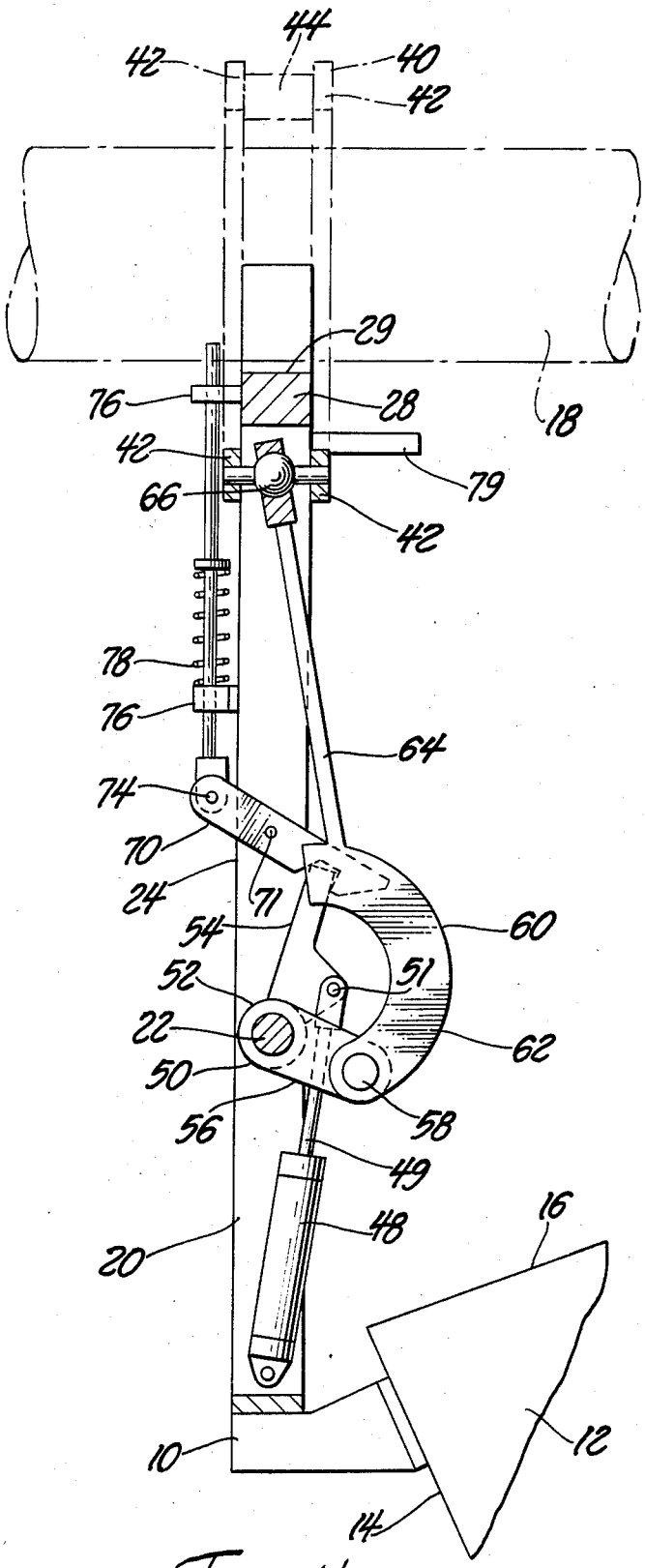
FIG. 4 is a sectional view taken in the same direction as FIG. 3, but showing certain components in different positions of adjustment.

The travel lock assembly preferably includes positive means for latching arm structure 24 in its prone (inactive) position, shown in FIGS. 6 and 7. The latching system comprises a latch device 70 having a swing connection 71 with one of bars 26. A rod-like probe element 72 has one end thereof pivotably connected to one end of latch device 70, as at 74. Guide elements 76, carried by arm structure 24, confine probe element 72 to essentially longitudinal motion. Compression coil spring 78 biases the probe element in a rightward direction (FIG. 7) or upward direction (FIG. 4).

Latch device 70 has a notch 75 therein engageable with section 77 of crank arm plate 54, whereby arm structure 24 is positively locked to crank arm 50. Arm structure 24 is equipped with a leg 79 engageable with hull upper face 16 when structure 24 is in its prone position (FIGS. 6 and 7).

Probe element 72 serves as an operator for latch device 70 in response to the engagement or non-engagement of gun barrel 18 on seat 29 (FIGS. 1 and 3). When the gun barrel is engaged with seat surface 29 probe element 72 is deflected to a condition wherein latch device 70 is inactive (ineffective for latch purposes). When the gun barrel is not engaged with seat surface 29 (because it is elevated to the dashed line position in FIG. 2 or because arm structure 24 is in its prone position) spring 78 biases probe element 72 to a condition wherein latch device 70 is active (i.e., effective for latch action on crank arm plate 54).

TRAVEL LOCK OPERATION

Figure 5:
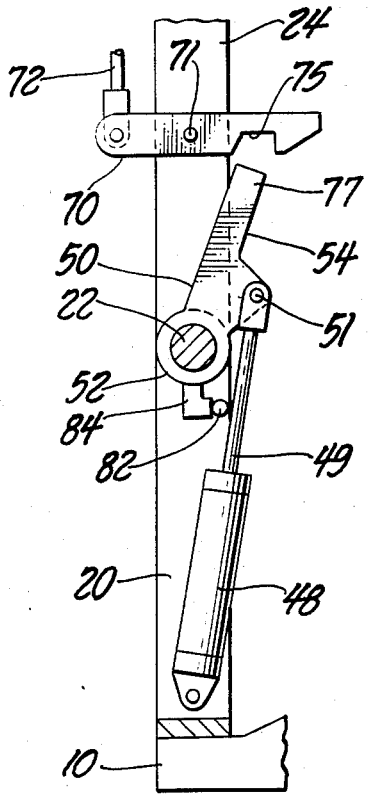
FIG. 5 is a fragmentary sectional view in the same direction as FIG. 3, but showing a further position of adjustment.

The travel lock has two operating positions, namely the prone (inactive) position shown in FIGS. 6 and 7 or the upright (active) position shown in FIGS. 3 and 4. To limit upward motion of arm structure 24 a stop element 84 may be affixed to collar 27 (FIGS. 1 and 5). A cooperating pin 82 may be affixed to one of bars 20.

With the component parts in the prone position (FIGS. 6 and 7) latch 70 operatively connects arm structure 24 and crank arm 50. Introduction of pressure fluid into the lower end of cylinder 48 swings arm structure 24 upwardly to the FIG. 4 position; clamp 40 will be open, as shown in FIG. 2.

With the component parts in the FIG. 4 upright position the gun barrel can be lowered from an elevated position (18*a* in FIG. 2) to a position engaged with seat 29. Rod 72 is thereby deflected to cause latch 70 to assume the position shown in FIGS. 3 and 5. At this time crank arm 50 is in the FIG. 5 position.

By introducing pressure fluid into the upper end of cylinder 48 crank arm 50 is rotated clockwise to the FIG. 3 position; arm structure 24 remains in its upright position. As crank arm 50 moves clockwise it pulls link member 60 downward, thereby closing clamp 40 on the gun barrel upper surface. FIGS. 1 and 3 show the positions of the component parts when the gun barrel is clamped in the travel lock mechanism. Piston rod 49 is retracted into cylinder 48.

To return the mechanism to the inactive (prone) position of FIGS. 6 and 7 pressurized fluid is first introduced into the lower end of cylinder 48. This action rotates crank arm 50 to the FIG. 5 position; counterclockwise rotation of crank arm 50 causes link member 60 to open clamp 48.

With clamp 40 in an open position the gun barrel can be raised (from within the turret) to an elevated position, as shown in FIG. 2. As the gun barrel leaves seat 29 rod 72 moves upwardly to swing latch 70 to the FIG. 4 position (engaged with crank arm 50).

Introduction of pressure fluid into the upper end of cylinder 48 causes the component parts to move to the prone position of FIGS. 6 and 7. Latch 70 transmits a drive force from crank 50 to arm structure 24.

MANUAL (EMERGENCY) OPERATING MODE

Figure 9:
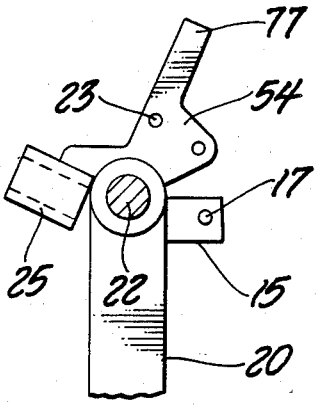
FIG. 9 is a fragmentary side elevational view of a structural detail that can be used in the FIG. 1 travel lock.

The structure thus far described requires an operable fluid cylinder 48. However, an emergency manual operation can be employed to move the travel lock between its active and inactive positions in the event of cylinder 48 malfunction (e.g., system leakage or failure of the fluid pressure source). FIG. 9 shows the manual emergency structure. It comprises a socket member 25 affixed to plate 54, a circular hole 23 formed in plate 54, and a circular hole 17 formed in a bracket 15 carried on one of bars 20.

Hole 23 is shown in FIGS. 6, 7 and 9. Socket member 25 is illustrated in full lines in FIG. 9, and in dashed lines in FIG. 6. Bracket 15 and hole 17 are shown only in FIG. 9. Such partial illustration of details is done in order to avoid obscuration of other structures.

In order to operate the mechanism manually it is first necessary to remove the pin normally used to form pivot connection 51; this disconnects cylinder 48 from crank arm 50. Springs 30 (FIG. 1) develop sufficient force to counterbalance the weight of arm structure 24. Therefore, arm structure 24 can be moved between its upright position and its prone position by a relatively slight manual effort directly on the arm structure. Clamp device 40 may be manually moved between its open and closed positions by means of a lever 19 (FIG. 6). The lever can be any rod or bar structure inserted into socket structure 25. The manual mode of operation can be used to position the mechanism in its prone position (FIG. 6).

Since cylinder 48 is now disconnected from crank arm 50 the mechanism will not by itself remain in the FIG. 6 prone position. To hold the mechanism in its prone position the aforementioned pin (51) is inserted through holes 23 and 17. The holes are oriented so that when arm structure 24 is in its prone position the two holes are aligned with each other. The pin acts as a latch.

SEATING OF THE GUN BARREL IN THE TRAVEL LOCK

Figure 8:
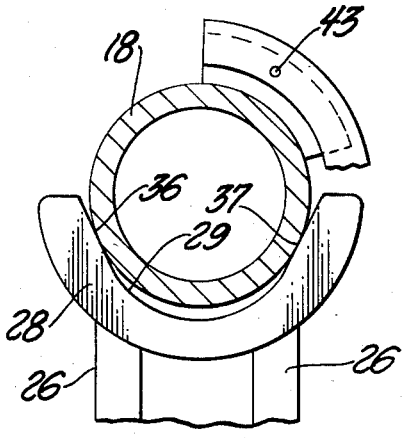
FIG. 8 is a fragmentary view illustrating a structural detail that may be employed in practice of the invention.

Manufacturing tolerances are such that the gun barrel may not be located precisely on the vertical centerline of the travel lock seat surface 29. FIG. 8 illustrates a seat surface configuration designed to at least partially overcome the tolerance problem. As seen in FIG. 8, seat surface 29 has a slightly out-of-round contour so as to form two laterally spaced seat areas 36 and 37. The lowest (central) area of surface 29 is spaced somewhat below the barrel 18 surface, such that the barrel engages seat 29 only at areas 36 and 37. Areas 36 and 37 cooperate with surface 45 on pad 44 to provide a three point grip on the gun barrel.

The mouth of concave seat 29 is preferably somewhat wider than the gun barrel diameter so that the barrel will contact seat 29 even though the barrel is not exactly on the travel lock centerline. The pivotal mount 43 for pad 44 also has a tolerance compensation effect.

ADVANTAGES OF THE INVENTION

A principal advantage of the invention is the fact that the travel lock can be operated remotely, i.e., from within the vehicle turret. No soldier is required to disembark from the vehicle in order to operate the travel lock between its locked and unlocked positions (FIGS. 3 and 6).

Another advantage of the invention is that only one power device (e.g., cylinder 48) is required in order to achieve the various motions of arm structure 24 and clamp device 40. A related advantage is that the power device is required to have only one stroke distance (between fully retracted and fully extended). There are no intermediate positions of the power device, so that control (valves) can be relatively simple.

A further advantage of the described arrangement is the fact that cylinder 48 is in its retracted mode (FIGS. 1, 3, 6 and 7) for the vast percentage of the time. Piston rod 49 is required to be extended from cylinder 48 only during the actual operations of raising or lowering arm structure 24; such operations are infrequent and of short duration.

While rod 49 is retracted into cylinder 48 it is protected from mud, sand, water, etc. that could degrade the seal between the rod and cylinder end wall. As noted above, rod 49 is retracted for most of the time; hence seal failure is unlikely with the illustrated system.

Another advantage of the illustrated structure is the fact that clamp device 40 has an over-center relationship to its motion plane. As seen in FIG. 3, the motion plane for clamp 40 is normal to the plane of the paper on a vertical line passing through the axis of shaft 22, generally along the midplane of arm structure 24. The axis of pivot 58 is slightly to the left of the motion plane for clamp 40. During vehicle travel over rough terrain the gun barrel can exert an upward force on clamp 40 (during jounce motion of the vehicle). Link member 60 is put in tension to absorb load forces that would otherwise open clamp 40. The location of pivot 58 (to the left of the clamp motion plane) is such that load forces cannot unloosen the clamp. Pivot 58 is in an over-center position whereby load force advantageously tightens the clamp instead of loosening it.

We wish it to be understood that we do not desire to be limited to the exact details of construction shown and described for obvious modifications will occur to a person skilled in the art, without departing from the spirit and scope of the appended claims.

We claim:

1. In association with a military vehicle having a main gun disposed for adjustments in the elevational plane: the improvement comprising a travel lock mechanism positioned on the vehicle for releasably locking the main gun in a fixed position relative to the vehicle, whereby the gun has minimal tendency to adversely affect vehicle road performance; said mechanism comporising a base structure (10) secured to the vehicle; an elongated arm structure (24) swingably attached at one end thereof to the base structure for movement around a horizontal axis between a prone position and an upright position; a gun seat (28) located on the other end of the arm structure for supportably engaging the undersurface of a gun barrel when the arm structure is in its upright position; a clamp device (40) having a movable connection (38) with the arm structure, whereby said clamp device can move between a closed condition engaged with the upper surface of the gun barrel and an open condition disengaged from the gun barrel; a crank arm (50) rotatably attached to the base structure for movement around a horizontal axis between first and second positions; an elongated link member (60), one end of said link member having a pivot connection with the crank arm, the other end of the link member having a pivot connection with the clamp device; means (72,70) responsive to movemment of the gun barrel away from the gun seat to latch said elongated arm structure to the crank arm; and a reciprocable power means (48,49) trained between said base structure and said crank arm, whereby motion of said power means is one direction rotates the crank arm from its first position to its second position so that the associated link member raises the elongated arm structure from its prone position to its upright position while the clamp device is retained in its open condition, after which the gun barrel can be lowered onto the gun seat to unlatch the crank arm from the elongated arm structure; motion of the power means in the other direction being then effective to shift the clamp device from irs open condition to its closed condition while returning the crank arm to its first position.

2. The mechanism of claim 1 wherein the base structure is located so that the elongated arm structure is swingable in a generally vertical plane coincident with the longitudinal axis of the vehicle; said clamp device being swingably connected to the elongated arm structure for movement in a plane normal to the swing plane of the arm structure.

3. The mechanism of claim 2 wherein the rotational axis of the crank arm is coincident with the swing axis of the elongated arm structure.

4. The mechanism of claim 3 wherein the base structure comprises a shaft (22); said elongated arm structure and crank arm being independently mounted on said shaft.

5. The mechanism of claim 1 wherein said latch means comprises a latch device (70) movably attached to the elongated arm structure at a point between the arm structure swing axis and the gun seat, and a deflectable probe element (72) trained between the gun seat and the latch device for moving said latch device in response to engagement and disengagement of the gun barrel relative to the seat; said latch device being aligned with a portion of the aforementioned crank arm for latching the elongated arm structure to the crank arm.

6. The mechanism of claim 1 wherein the pivot connection between the link member and crank arm is located so that it passes through the motion plane of the clamp device during movement of said power means, whereby upward force exerted by the gun barrel on the clamp device is ineffective to loosen the clamp device from the barrel.

7. The mechanism of claim 1 wherein the power means is a fluid cylinder.

8. The mechanism of claim 1 wherein the crank arm comprises a rotary sleeve (52), a first plate (54) carried by the sleeve for operative connection with the power means, and a second plate (56) carried on the sleeve for operative connection with the link member.

9. The mechanism of claim 1 wherein said base structure comprises a shaft (22); said crank arm and elongated arm structure being independently mounted for rotary swinging motions on said shaft; aid elongated link member having a c-shaped section arranged to curl around the shaft when the clamp device is in a closed condition engaged with the gun barrel.

10. In association with a military vehicle having a main gun disposed for adjustments in the elevational plane; the improvement comprising a travel lock mechanism positioned on the vehicle for releasably locking the main gun in a fixed position relative to the vehicle, whereby the gun has minimal tendency to adversely affect vehicle road performance; said mechanism comprising a base structure locatable on the front end of the vehicle; an elongated arm structure swingably attached at one end thereof to the base structure for movement between a prone positioned and an upright position; a gun seat (28) affixed to the other end of the arm structure for supportably engaging the undersurface of a gun barrel when the arm structure is in its upright position; a clamp device (42) having a movable connection with the arm structure, whereby said clamp device can move between a closed condition engaged with the upper surface of the gun barrel and an open condition disengaged from the gun barrel; a crank arm (50) rotatably attached to the base structure for rotary motion around a horizontal axis; an elongated link member (60), one end of said link member having a pivot connection with the crank arm, the other end of said link member having a pivot connection with the clamp device for moving same between its opened and closed positions; a probe (72) movably positioned on the elongated arm structure for deflection by the gun barrel when the barrel moves downwardly onto the gun seat; a probe-operated latch device (70), movably mounted on the elongated arm structure for locking the crank arm to the elongated arm structure when the probe is in an undeflected condition; and a reciprocable power means connected between the base structure and crank arm for moving said crank arm around said horizontal axis.

* * * * *